US005090924A

United States Patent [19]

Pfaller et al.

[11] Patent Number: 5,090,924

[45] Date of Patent: Feb. 25, 1992

[54] CATHODIC PROTECTION ANODE, CONNECTOR, AND METHOD OF MAKING

[75] Inventors: Mathew A. Pfaller; Kenneth N. Baker, both of Houston, Tex.; Richard E. Say, Spencer, Ohio

[73] Assignee: Materials Protection Company, Houston, Tex.

[21] Appl. No.: 690,657

[22] Filed: Apr. 24, 1991

[51] Int. Cl.[5] ..... H01R 4/42

[52] U.S. Cl. ..... 439/807; 24/136 B; 403/374; 439/938

[58] Field of Search ..... 439/807, 783, 863, 938; 403/374, 370, 409.1; 24/115 M, 136 R, 136 B

[56] References Cited

U.S. PATENT DOCUMENTS

| | | | |
|---|---|---|---|
| 2,086,090 | 7/1937 | Ohlson | 439/807 |
| 2,547,176 | 4/1951 | Salmons | 439/807 |
| 2,859,425 | 11/1958 | Felton | 439/807 |
| 4,125,919 | 11/1978 | Dumont | 24/115 M |
| 4,511,204 | 4/1985 | Glenn | 439/807 |
| 4,515,669 | 5/1985 | Dimond et al. | 439/863 |

FOREIGN PATENT DOCUMENTS

| | | | |
|---|---|---|---|
| 1680568 | 9/1977 | Fed. Rep. of Germany | 403/374 |
| 592789 | 8/1925 | France | 403/374 |

*Primary Examiner*—Gary F. Paumen

*Attorney, Agent, or Firm*—Renner, Otto, Boisselle & Sklar

[57] ABSTRACT

A tubular anode includes an electrical connector formed of a diagonally split two-part generally cylindrical slug. The diagonal slit provides an elliptical wedge interface between the two parts and a jack screw is threaded in one part and extends through an enlarged hole in the other. Tightening the jack screw within the tube causes the two parts to offset and wedge against the inside of the tube. The two parts include an aligned slot which intersects the major axis of the elliptical interface and a lead wire or cable is electrically secured to one of the parts within its slot. The slot is configured to press the lead or cable against the interior of the tube. The lead wire for a string anode extends through the slot of the other part. In the formation of an anode string the tubular anodes are threaded onto unspooled insulated wire or cable, a short portion of the insulation is removed at each connector location, and with the tubular anode offset, a connector is secured to the bare wire. The tube is threaded over the connector and the connector locked in place. The connector may be encapsulated by filling the interior with a potting compound or sealant. The connector and process is particularly useful with relatively small diameter titanium, niobium or tantalum tubular anodes.

14 Claims, 2 Drawing Sheets

CATHODIC PROTECTION ANODE, CONNECTOR, AND METHOD OF MAKING

DISCLOSURE

This invention relates generally as indicated to a cathodic protection anode and connector; more particularly to a tubular anode and connection; and also to a method of making a continuous lead wire string anode using such connector.

BACKGROUND OF THE INVENTION

Tubular anodes are widely used in cathodic protection, and may be formed of a variety of materials such as high silicon cast iron, graphite, carbon, magnetite, steel, titanium, niobium, and tantalum and alloys thereof. Titanium tubular anodes with mixed metal oxide exterior coatings are now employed. These tubular anodes are relatively long, yet of small diameter and fairly thin walled.

These mixed metal oxide anodes are used in deep or surface ground bed applications to protect pipelines, underground storage tanks, etc. from corrosion. A compression tool is used to establish an electrical connection from cable to anode at either one or both anode ends. During anode operation, problems associated with corrosion and ultimate penetration of these anode walls results in anode loss due to connection failure. This is extremely critical in the case of multiple anodes assembled on strings whereby one anode penetrated results in loss of succeeding anodes on the string.

In prior U.S. Pat. No. 4,515,669 dated May 7, 1985 there is disclosed a wedge type electrical connection which has been quite successful and widely used in relatively large diameter tubular anodes such as high silicon cast iron anodes. In such patent, FIGS. 8 and 9, there is disclosed an embodiment wherein the wedge parts are drawn together by a threaded stud, and a nut/cinch assembly. While this embodiment may have utility in fairly large internal diameter tubes, in a smaller and long tube it would have little practical utility.

Also, if a string anode is formed with the wedge connection of such prior patent, separate leads are required from anode to anode, requiring two lead connections, one to each part of the wedge connection. It would be advantageous if a continuous lead wire could be employed in a string with each anode connected electrically but once to the wire.

The present invention comprises then certain improvements in an anode and wedge connection such as seen in prior U.S. Pat. No. 4,515,669.

SUMMARY OF THE INVENTION

A tubular anode includes an electrical connector formed of a diagonally split two-part generally cylindrical slug. The diagonal slit provides an elliptical wedge interface between the two parts and a jack screw is threaded in one part and extends through an enlarged hole in the other. Tightening the jack screw within the tube causes the two parts to offset and wedge against the inside of the tube. The two parts include an aligned slot which intersects the major axis of the elliptical interface and a lead wire or cable is electrically secured to one of the parts within its slot. The slot is configured to press the lead or cable against the interior of the tube. The lead wire for a string anode extends through the slot of the other part. In the formation of an anode string the tubular anodes are threaded onto unspooled insulated wire or cable, a short portion of the insulation is removed at each connector location, and with the tubular anode offset, a connector is secured to the bare wire. The tube is threaded over the connector and the connector locked in place. The connector may be encapsulated by filling the interior with a potting compound or sealant. The connector and process is particularly useful with relatively small diameter titanium tubular anodes.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
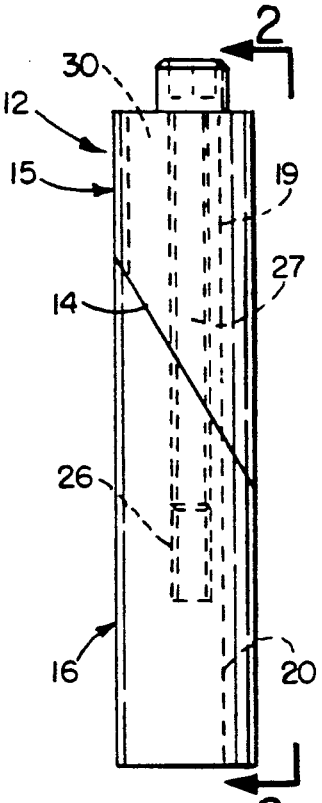
FIG. 1 is a side elevation of a connector in accordance with the present invention.
Figure 2:
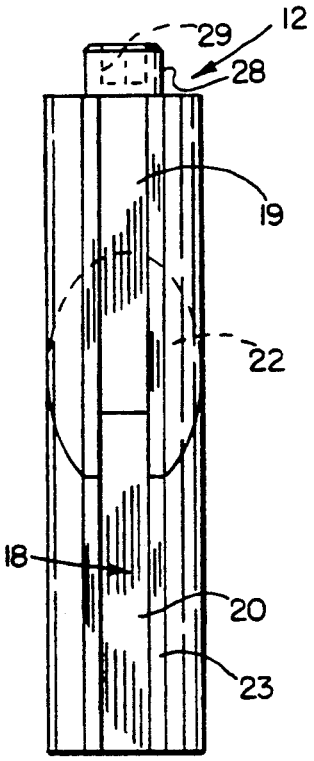
FIG. 2 is a front elevation of the connector as seen from the line 2—2 of FIG. 1.

Referring now to the drawings there is illustrated the tube of the anode at 10 and the electrical connector therefor at 12. The tube is shown in FIGS. 5, 6, 7 and 8. The connector alone is shown in FIGS. 1 and 2 while the connector with the lead wire or cable attached is shown in FIGS. 3 and 4.

Referring initially to FIGS. 1-4 it will be seen that the connector 12 comprises a two-part generally cylindrical slug which is diagonally split as indicated at 14 to form a first or one part 15 and a second or other part 16. In the position seen in FIGS. 1 and 2 both parts are provided with an aligned channel or slot 18 which is formed by the channel or slot 19 in the first part and the slot or channel 20 in the second part. The aligned slots 19 and 20 also have a center axis of alignment which intersects the major axis of the elliptical interface shown at 22 between the two parts created by the diagonal slit 14. The edges of the aligned channels are relieved as indicated by the flats at 23 to permit the cable or wire to project beyond the circle of the cylinder to bear against the tube when the connector is tightened.

The second part 16 is provided with an axial tapped hole seen at 26 in which is threaded a jack screw 27 which is provided with an enlarged cap 28 having a hexagonal socket 29. While threaded into the second part, the jack screw extends with clearance through enlarged hole or slot 30 in the first part 15. In the illustrated embodiment the hole 30 is an enlarged slot which is extended in the same direction as the major axis of the elliptical interface 22.

Figure 3:
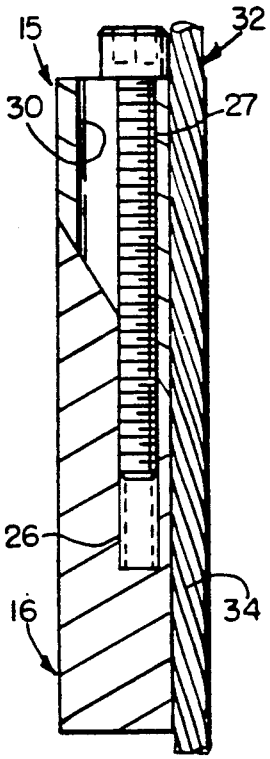
FIG. 3 is a transverse section of the connector as taken from the plane of FIG. 1 or normal to FIG. 2, and showing a wire or cable connected thereto.
Figure 4:
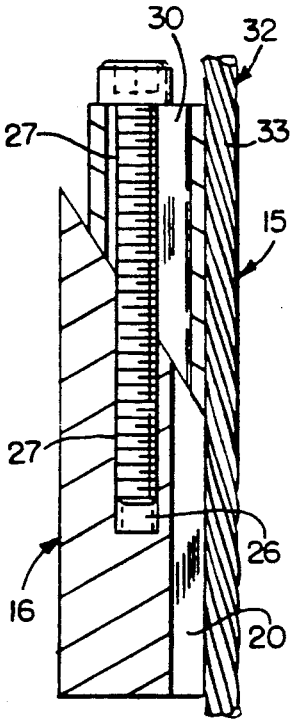
FIG. 4 is a similar section illustrating the relative movement of the two parts.
Figure 5:
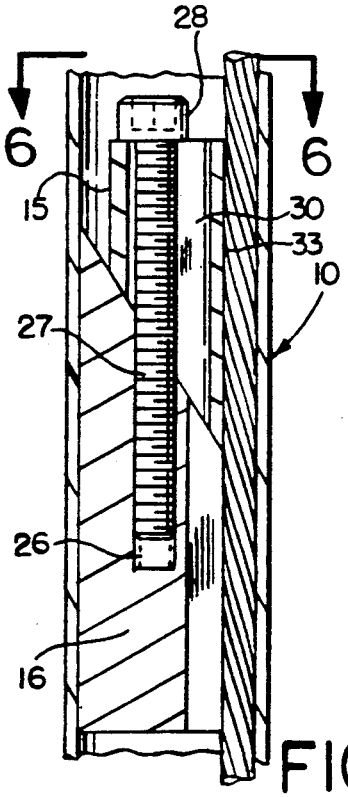
FIG. 5 is a similar section illustrating the connector secured inside the anode.
Figure 6:
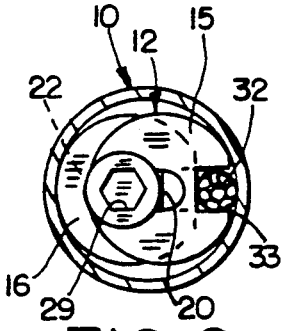
FIG. 6 is a horizontal section through the anode above the connector as seen from the line 6—6 of FIG. 5.

Referring now to FIGS. 3 and 4, such figures illustrate the continuous lead or cable shown at 32 electrically secured at 33 in the channel 19 of the one or first part 15. The lead or cable may be secured in such channel by soldering, brazing, or even exothermic welding. As indicated at 34 the lead or cable simply extends through the slot 20 in the other part.

As can be seen in comparing FIGS. 3 and 4, when the jack screw 27 is tightened down, the two parts of the connector move along the wedge interface and the part 15 becomes axially offset from the part 16 forcing the cable or wire against the inside of the tube.

In operation, the connector is inserted with close clearance into the interior of the tube 10, preferably to the center or midway between the ends of the tube. A suitable hex driving tool is then employed to rotate the jack screw causing the two parts to move relative to each other axially and laterally along the diagonal elliptical wedge interface with the two parts wedging or bearing firmly against the interior of the tube as illustrated. Such tightening of the jack screw forces the lead or cable 32 and the brazed connection 33 directly against the interior wall of the tube. When the jack screw has been suitably torqued the cable or lead is electrically connected to the anode.

Figure 7:
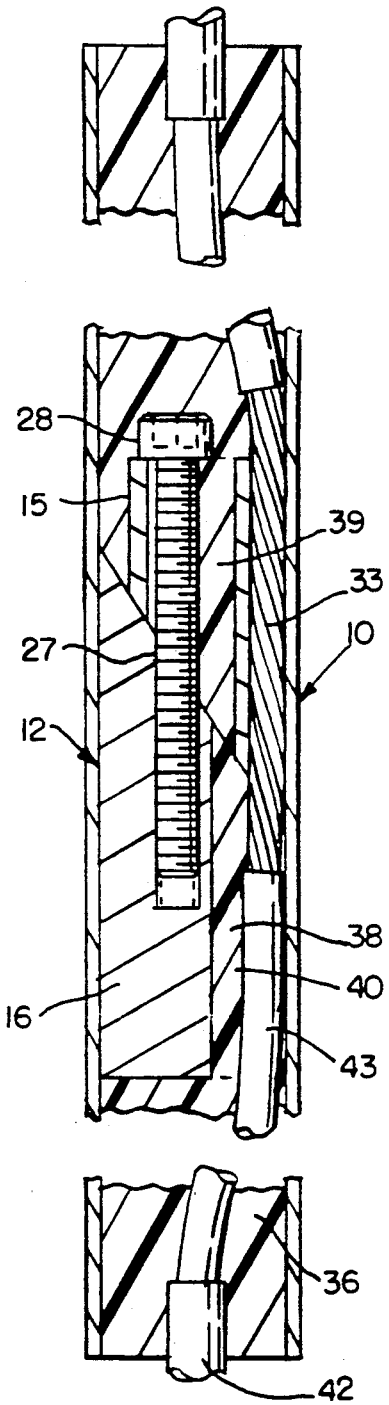
FIG. 7 is a longitudinal section broken away of a center connected anode in accordance with the present invention.

As seen in FIG. 7, once the connector is secured in the center of the anode the interior of the anode may preferably be filled with a special high dielectric sealant or potting compound indicated at 36. The anode may be filled with such sealant simply by plugging one end and pouring it in from the opposite end with the sealant in liquid condition running through the connector as indicated in FIG. 7 at 38. The sealant simply runs through the enlarged jack screw slot as indicated at 39 and through the clearance slot as indicated at 40. Alternatively the sealant may be placed by pouring from both ends in two steps or injected into one or both ends. When the sealant solidifies the connector is encapsulated within the interior of the anode.

Also as seen in FIG. 7 the lead 33 may be a No. 6 or No. 8 dual jacketed cable which is normally provided with a relatively heavy exterior jacket 42 and an interior jacket 43, the latter being KYNAR insulation material. KYNAR ® is a registered trademark of Pennwalt Corporation of Philadelphia, Pa. The exterior jacket is removed from a point inside the ends of the anode and the interior jacket is removed from the cable or lead at the brazing area or as the cable passes through the slots of the connector. In any event, as seen in FIG. 7 there is provided a secure center connected anode for small diameter thin walled titanium tube and the like. As an example, the drawings are at about twice the scale of such tubing, and a single anode may be about four feet in length.

Figure 8:
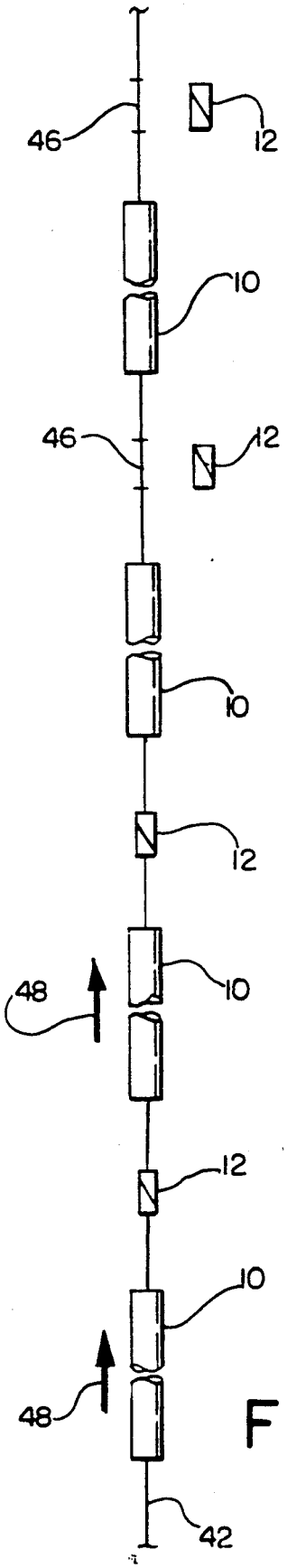
FIG. 8 is a schematic illustration of the process steps involved in utilizing the connector of the present to form an anode string.

FIG. 8 illustrates a method of forming an anode string using the thin walled tubular titanium, niobium or tantalum anodes of the present invention and the connector of the present invention. As illustrated in FIG. 8 a length of cabling 42 is unspooled and a series of tubular anodes 10 are simply threaded thereover. With the anode 10 offset as indicated at the top of FIG. 8, a short length of insulation is removed as seen at 46 and the connector 12 is brazed to the cable. The tubular anode which has been offset is then simply moved in the direction of the arrows 48 to thread the tubular anodes over the connectors secured to the cabling until the connectors are in the center of the anode. The connectors are then tightened down and the anode filled with sealant to encapsulate the connector in the center of the anode. In this manner a string of center connected anodes can easily be formed without cutting the conductor and without crimping or physically damaging the anode in any way.

It can readily be seen that the present invention then provides a screw lock connector which can easily be centrally located inside the tubular anode body and which when tightened compresses the anode lead wire to the body of the anode. After the connection is effected, the anode is filled with the high dielectric sealant material and this provides an effective center connected anode which alleviates problems which may be caused by the use of a compression tool to establish an electrical connection from the cable to the anode at either one or both anode ends.

While the invention is particularly useful with the small diameter thin walled titanium, niobium or tantalum tubular anodes with the oxide exterior coating, the invention is also useful with other types of tubular anodes. The two parts of the connector may readily be fabricated from a conductive slightly malleable metal or alloy such as brass, copper, zinc, aluminum or steel.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. An electrical connector for a tubular anode comprising a diagonally split two-part generally cylindrical slug, jack means to drive said parts toward each other to offset one from the other along the diagonal split, and means to secure a lead wire to one of said parts comprising a continuous slot extending along a side of the parts, whereby an electrical lead may be connected to one of said parts in its slot and forced against the inside of the tubular anode when the parts are driven toward each other by said jack means.

2. A connector as set forth in claim 1 wherein said jack means comprises a screw threaded in one part and extending through a diametrically enlarged hole in the other part.

3. A connector as set forth in claim 2 wherein said diagonal split forms a generally elliptical wedge interface between the two parts, said hole being enlarged along the major axis of the interface.

4. A connector as set forth in claim 1 wherein said aligned slots substantially intersect the long axis of the wedge interface.

5. A connector as set forth in claim 3 wherein said jack screw includes a drive head exposed at the end of the other part opposite the wedge interface.

6. A tubular anode for cathodic protection comprising a tube and an internal electrical connector, said connector comprising a diagonally split generally cylindrical two-part slug, a lead wire secured to one of said parts, and jack means to drive said parts axially toward each other to offset said parts laterally and wedge them and said lead wire against the inside of the tube to provide an electrical connection thereto.

7. An anode as set forth in claim 6 wherein said jack means comprises a screw threaded in one part and extending through a diametrically enlarged hole in the other part.

8. An anode as set forth in claim 7 wherein said diagonal split forms a generally elliptical wedge interface between the two parts, said hole being enlarged along the major axis of the interface.

9. An anode as set forth in claim 8 including substantially aligned slots along the sides of the parts, an electrical lead connected to one of said parts in its slot, and clearing the other part through the slot of the other part.

10. An anode as set forth in claim 9 wherein said aligned slots substantially intersect the long axis of the wedge interface.

11. An anode as set forth in claim 8 wherein said jack screw includes a drive head exposed at the end of the other part opposite the wedge interface.

12. An anode as set forth in claim 6 wherein said tube is titanium, niobium or tantalum, and said connector is a somewhat malleable conductive metal or alloy.

13. An anode as set forth in claim 12 wherein said connector is encapsulated in said tube by a sealant.

14. An anode as set forth in claim 9 wherein the lead is electrically connected to said one part in its slot by brazing, and the brazed lead is forced against the interior of the tubular anode by said jack means.

* * * * *